US005332611A

United States Patent [19]

Shanok et al.

[11] Patent Number: 5,332,611

[45] Date of Patent: Jul. 26, 1994

[54] SHELF EDGE TRIM

[75] Inventors: William Shanok, New York, N.Y.; Daniel Shanok; Frederick Shanok, both of Warren, N.J.; Ronald Good, Bloomfield Hills, Mich.; Joseph Limansky, East Brunswick, N.J.; Victor Shanok; Jesse P. Shanok, both of New York, N.Y.

[73] Assignee: Silvatrim Associates, South Plainfield, N.J.

[21] Appl. No.: 27,844

[22] Filed: Mar. 8, 1993

[51] Int. Cl.[5] ..... E06B 7/16

[52] U.S. Cl. ..... 428/122; 49/501; 108/27; 428/358

[58] Field of Search ..... 428/122, 358, 14; D6/511, 574; 49/501; 108/27

[56] References Cited

U.S. PATENT DOCUMENTS

| | | | |
|---|---|---|---|
| 2,646,326 | 7/1953 | Stanitz | 108/27 |
| 3,204,357 | 9/1965 | Marschak | 428/122 X |
| 3,730,577 | 5/1973 | Shanok et al. | 428/900 X |
| 4,031,665 | 6/1977 | Abramson | 49/501 |
| 4,349,994 | 9/1982 | Maekawa | 428/122 X |
| 4,659,869 | 4/1987 | Busby | 428/188 X |
| 4,781,961 | 11/1988 | Weaver et al. | 428/122 |

*Primary Examiner*—Henry F. Epstein

*Attorney, Agent, or Firm*—Goodman & Teitelbaum

[57] ABSTRACT

A shelf edge trim having a one piece integral construction to provide a U-shaped body portion for removably receiving and supporting a shelf of a refrigerator, freezer, a piece of furniture and the like, the edge trim being formed from an extruded plastic strip, where the edge trim can have a decorative front lip portion for a front edge of the shelf, or a rearwardly and upwardly extending flange portion for a rear edge of the shelf to provide a rear stop for the shelf. A bin sealing portion can be provided on the edge trim for sealing a space between the shelf and a slide-out storage drawer depending therefrom. In one embodiment, the lower leg portion of the U-shaped body portion is provided with an inwardly directed rib for engaging an underside of the shelf. In another embodiment, the edge trim is provided with a bar gripping portion for receiving a support bar of the shelf frame. Preferably, the lower leg portion of the U-shaped body portion is provided with a cam portion to guide the edge portion of the shelf into the U-shaped body portion for positioning between the upper and lower leg portions thereof. The edge trim can be used in the construction of a table, where the shelf is the table top, and the front and rear edge trims have an identical construction, being disposed on the front and rear support bars of the table.

20 Claims, 5 Drawing Sheets

SHELF EDGE TRIM

BACKGROUND OF THE INVENTION

The invention relates to shelves for refrigerators, freezers, furniture and the like, and more particularly, to a shelf edge trim having a U-shaped body portion for removably receiving and supporting the shelf therein in a secured arrangement.

Shelf edge trims are well known in the art, however the prior art shelf edge trims are usually fixedly secured to the shelf, and therefore the shelf can not be removed therefrom. In many cases, a gasketing material is provided around the shelf upon which the shelf edge trim is inserted and secured by conventional means, such as an adhesive, in order to prevent rattling and breakage of the shelf, usually a glass plate, when in contact with the shelf edge trim.

Furthermore, a large amount of labor time and cost is usually required for the assembly of the prior art shelf edge trim, as well as additional costs for the numerous parts required for the assembly.

Accordingly, there is presently a need for a shelf edge trim that has a one piece integral construction, that can be removably secured to the shelf, that permits the assembly thereof without any damage to the surface of the shelf or to the surface of the shelf edge trim, that eliminates the need for a gasketing material around the shelf, that reduces the labor time and costs in the assembly thereof, that permits the shelf edge trim to remain securely in place on the shelf without any additional parts, and that is inexpensive to manufacture and can easily be installed at a reasonable cost.

SUMMARY OF THE INVENTION

It is accordingly an object of the present invention to provide a shelf edge trim for refrigerators, freezers, furniture and the like which avoids the problems and disadvantages of the prior art devices.

Another object of the present invention is to provide a shelf edge trim which has a one piece integral construction including a U-shaped body portion for removably receiving and supporting a shelf therein in a secured arrangement.

A further object of the present invention is to provide a shelf edge trim, as described above, which can be formed from an extruded plastic strip.

Still another object of the present invention is to provide a shelf edge trim, as described above, which is provided with bin sealing means for sealing a space between the shelf and a slide-out storage drawer depending therefrom.

Another object of the present invention is to provide a shelf edge trim, as described above, which has a decorative front lip portion when disposed on a front edge portion of the shelf, and a rearwardly and upwardly extending flange portion when disposed on a rear edge portion of the shelf to provide a rear stop for the shelf.

Yet another object of the present invention is to provide a shelf edge trim, as described above, wherein a free end portion of the lower leg portion of the U-shaped body portion is provided with an inwardly directed rib for engaging an underside of the edge portion of the shelf.

A further object of the present invention is to provide a shelf edge trim, as described above, which includes bar engaging means for receiving a support bar of the shelf frame.

Another object of the present invention is to provide a shelf edge trim, as described above, wherein the bar engaging means has an upwardly directed free end and a spaced apart downwardly directed pointed tab in alignment therewith to capture the bar within the bar engaging means.

Yet another object of the present invention is to provide a shelf edge trim, as described above, wherein the lower leg portion of the U-shaped body portion is provided with cam means to guide the edge portion of the shelf into the U-shaped body portion between the upper and lower leg portions thereof.

And still another object of the present invention is to provide a shelf edge trim, as described above, wherein the shelf is a table top, and identical front and rear shelf edge trims are disposed on front and rear bars of the table.

And still yet another object of the present invention is to provide a shelf edge trim, as described above, which can be easily and inexpensively manufactured, and which permits the shelf edge trim to be simply and quickly installed on the shelf, and which also permits the removal thereof.

Briefly, in accordance with the present invention, there is provided a shelf edge trim having a one piece integral construction to provide a U-shaped body portion for removably receiving and supporting a shelf of a refrigerator, freezer, a piece of furniture and the like, in a secured arrangement, the edge trim being formed from an extruded plastic strip. When disposed on a front edge of the shelf, the edge trim can have a decorative front lip portion. When disposed on a rear edge of the shelf, the edge trim can be provided with a rearwardly and upwardly extending flange portion to provide a rear stop for the shelf. Additionally, bin sealing means can be provided on the edge trim for sealing a space between the shelf and a slide-out storage drawer depending therefrom.

In one embodiment, a free end portion of the lower leg portion of the U-shaped body portion is provided with an inwardly directed rib for engaging an underside of the edge portion of the shelf, where the shelf is supported on support members secured to the bars of the shelf frame.

In another embodiment, the edge trim is provided with bar engaging means for receiving a support bar of the shelf frame. The bar engaging means has an upwardly directed free end and a spaced apart downwardly directed pointed tab in alignment therewith to capture the bar within the bar engaging means. Preferably, the lower leg portion of the U-shaped body portion is provided with cam means to guide the edge portion of the shelf into the U-shaped body portion between the upper and lower leg portions thereof.

The shelf edge trim can be used in the construction of a table, where the shelf is the table top. In this embodiment, the front and rear shelf edge trims have an identical construction, being disposed on the front and rear bars of the table.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

In the various figures of the drawings, like reference characters designate like parts.

DESCRIPTION OF THE PREFERRED EMBODIMENTS

Figure 1:
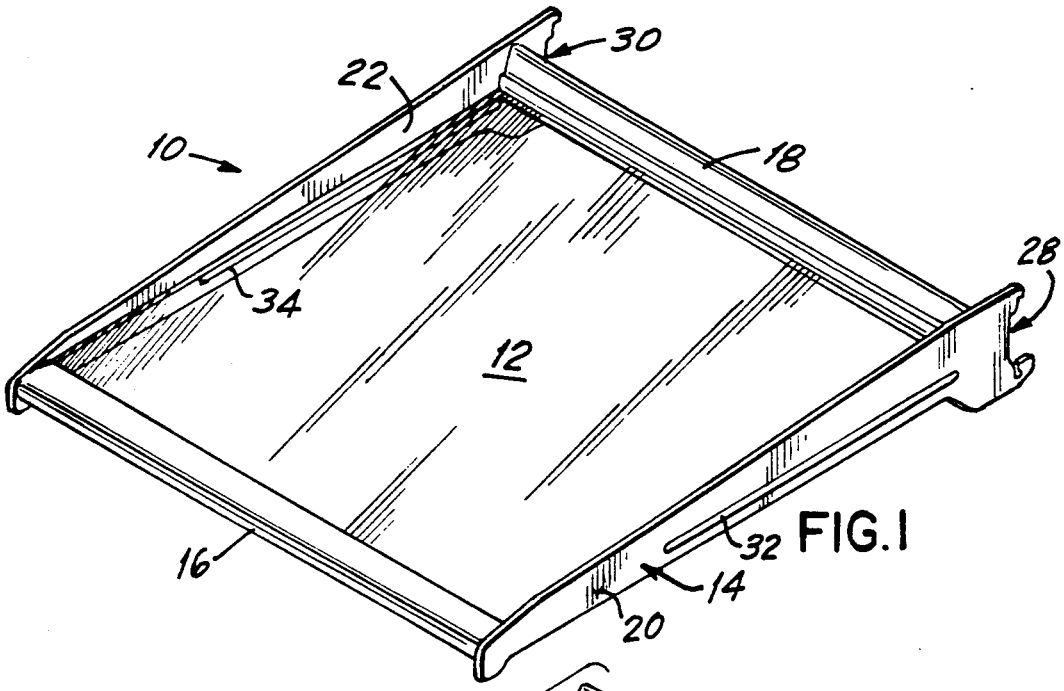
FIG. 1 is a perspective view showing a refrigerator or freezer shelf assembly provided with front and rear edge trims in accordance with the present invention.
Figure 2:
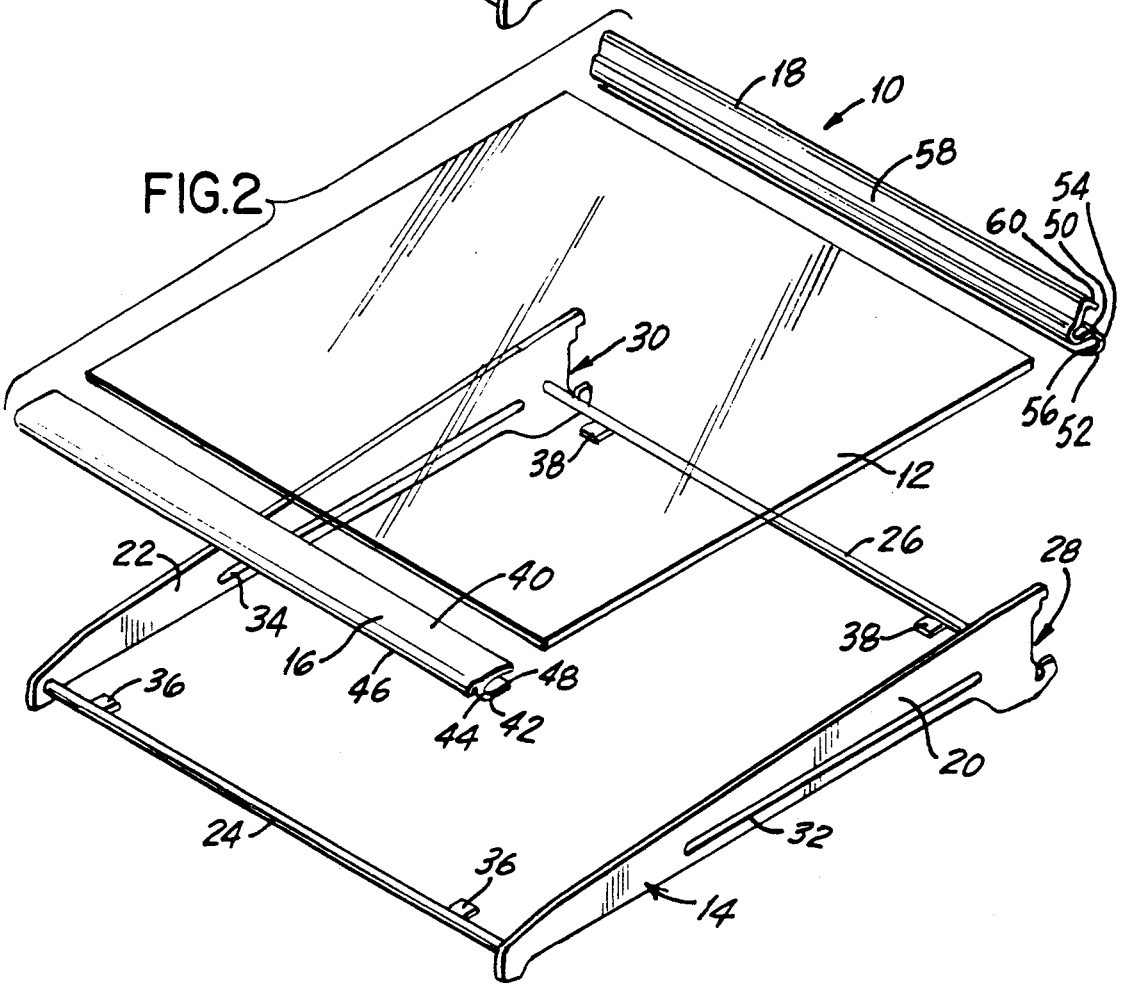
FIG. 2 is an exploded perspective view of the shelf assembly shown in FIG. 1.

Referring now to the drawings, FIGS. 1 and 2 show a shelf assembly 10, particularly for refrigerators and freezers, including a shelf 12 preferably in the form of a glass plate, a frame 14 for supporting the shelf 12, a front edge trim 16 and a rear edge trim 18 for enclosing the exposed front and rear edges of the shelf 12 in a supporting arrangement in accordance with the present invention.

As best shown in FIG. 2, the frame 14 includes two spaced apart side frame portions 20, 22 and a pair of transversely extending bars or rods 24, 26. The bar 24 is securely fixed between the front end portions of the side frame portions 20, 22 to secure the front end portions together in a predetermined spaced apart arrangement. Likewise, the bar 26 is securely fixed between the rear end portions of the side frame portions 20, 22 to further secure the rear end portions together in the predetermined spaced apart arrangement. Each of the side frame portions 20, 22 tapers outwardly from the front end portions thereof to the rear end portions thereof to provide enlarged rear end portions thereon. The rear ends of the side frame portions 20, 22 are provided with conventional attachment means 28, 30, respectively, which are well known in the art for hooking the shelf assembly 10 onto the rear wall of a refrigerator or freezer, where a further discussion thereof is not thought necessary.

Additionally, each of the side frame portions 20, 22 is preferably indented to provide longitudinally extending, inwardly directed ribs 32, 34, respectively, facing toward each other for supporting the side edges of the shelf 12. It is understood, that the width of the shelf 12 is substantially equal or just slightly less than the predetermined distance between the side frame portions 20, 22. Furthermore, the longitudinal length of the shelf 12 is substantially equal or just slightly less than the distance between the bars 24, 26. Accordingly, additional support members 36, 38 having flat surfaces are secured by conventional means, such as by welding, to the undersides of the bars 24, 26, respectively, so that the support members 36, 38 extend inwardly towards each other for supporting the front and rear edges of the shelf 12. Though only two support members 36 are shown on the front bar 24, and two support members 38 are shown on the rear bar 26, it is understood that additional support members 36, 38 may be added if necessary.

Both the front and rear edge trims 16, 18 are formed from extruded plastic strips each having a continuous length which is cut to size to match the width of the shelf 12, which is approximately the same as the distance between the side frame portions 20, 22. The plastic strips are extruded from a thermoplastic material, such as acrynitrile butadiene styrene commonly referred to as ABS. The plastic strips can be made in any color or texture as desired to provide a particular decorative appearance. Preferably, the exposed portions of the strip, which form exposed upper and front portions of the front and rear edge trims 16, 18 are transparent and encapsulate a metallic strip therein, such being well known in the art and disclosed in U.S. Pat. No. 3,730,577 to which reference may be made. Thus, the exposed portions of the front and rear edge trims take on a metallic appearance. For example, if the metallic strip has a silver metallic-like finish, then the exposed portions would have a metallic appearance. On the other hand, if the metallic strip has a wood grain finish, then the exposed portions would have the appearance of wood. Preferably, the metallic strip is fabricated from a metalized mylar or any other suitable material such as tin foil and the like, which is fed in during the extruding process. If desired, the metallic strip can be fabricated from a stiff rigid metal material to strengthen the front and rear edge trims 16, 18.

The front edge trim 16 as best shown in FIG. 2, has a longitudinally extending, substantially U-shaped body including an upper leg portion 40, a lower leg portion 42 and a substantially rounded front bight portion 44. A longitudinally extending front lip portion 46 extends outwardly and downwardly from the front portion of the upper leg portion 40 to overhang the bight portion 44 in a spaced apart arrangement. The free end portion of the lower leg portion 42 is first upwardly turned inwardly towards the upper leg portion 40, and then downwardly turned outwardly in a direction away from the upper leg portion 40 to provide a longitudinally extending, inwardly directed rib 48 at the free end of the lower leg portion 42, the function of which will be set forth below.

As mentioned above, the upper leg portion 40 and/or the lip portion 46 are transparent, or portions thereof are transparent, and encapsulate a metallic strip therein to take on a metallic appearance. Preferably, when used in refrigerators or freezers, the remaining portions of the front edge trim 16, such as the lower leg portion 42 and the bight portion 44, are fabricated in a white color.

Likewise, the rear edge trim 18 as best shown in FIG. 2, has a longitudinally extending, substantially U-shaped body including an upper leg portion 50, a lower leg portion 52 and a substantially rounded rear bight portion 54. The free end portion of the lower leg portion 52 is first upwardly turned inwardly towards the upper leg portion 50 and then downwardly turned outwardly in a direction away from the upper leg portion 50 to provide a longitudinally directed inwardly extending rib 56 at the free end of the lower leg portion 52, similar to the rib 48 of the front edge trim 16, the function of which will be set forth below.

A longitudinally extending front flange portion 58 extends rearwardly and upwardly from the front portion of the upper leg portion 50 to overhang the upper leg portion 50 in a spaced apart arrangement. The flange portion 58 functions as a stop at the rear end of the shelf 12. Accordingly, the flange portion 58 can have different configurations to provide an appropriate decorative appearance. In this case, the free end portion 60 of the flange portion 58 is rearwardly turned to provide a decorative finish thereto.

Here again, as indicated above, the flange portion 58 is transparent, or portions thereof are transparent, and encapsulate a metallic strip therein to take on a metallic appearance. Preferably, when used in refrigerators or freezers, the remaining portions of the rear edge trim 18, such as the upper and lower leg portions 50, 52 and the bight portion 54, are fabricated in a white color.

Figure 3:
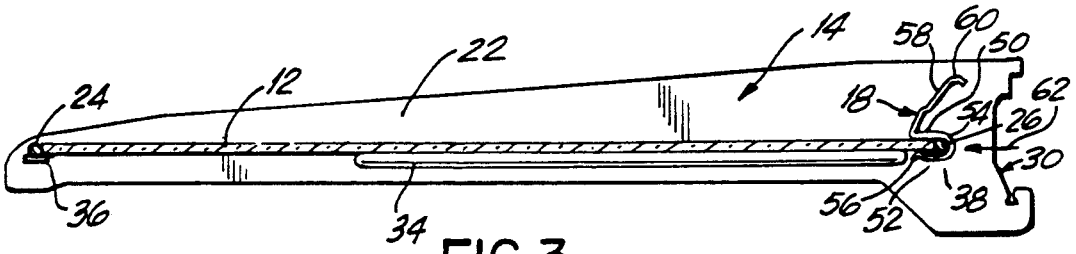
FIG. 3 is a side elevational view, partly in section, showing the rear edge trim assembled on the shelf.
Figure 4:
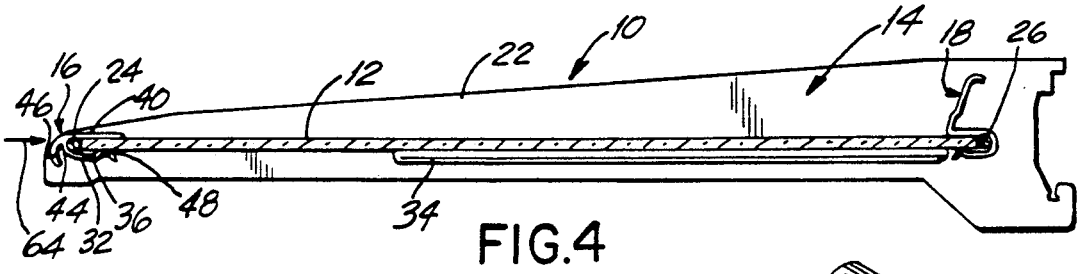
FIG. 4 is a side elevational view, partly in section, similar to FIG. 3, showing the front edge trim also assembled on the shelf.

Referring now to FIGS. 3 and 4, the assembling procedure for the shelf assembly 10 will now be described. As shown in FIG. 3, the shelf 12 is placed in the frame 14 so that the shelf 12 rests on the ribs 32, 34 formed in the side frame portions 20, 22, and also rests on the support members 36, 38 which are secured to the undersides of the bars 24, 26, respectively. The shelf 12 is now supported on the frame 14.

Obviously, either one of the front and rear edge trims 16, 18 can now be mounted on the frame 14, where FIG. 3 shows that the rear edge trim 18 is first mounted. The open end of the U-shaped body of the rear edge trim 18 is longitudinally lined up with the rear bar 26. Then, the rear edge trim 18 is mounted by being pushed in the direction of arrow 62 towards the shelf 12 so that the bar 26 is received therein within the bight portion 54. During this procedure, the rib 56 engages the lower surface of the support member 38 so that the upper and lower leg portions 50, 52 are slightly spread apart. Once the rib 56 is pushed past the support member 38, the upper and lower leg portions 50, 52 snap back so that the rib 56 now engages the lower surface of the shelf 12, with the upper leg portion 50 being engaged against an upper surface of the shelf 12, as shown in FIG. 3. The rear portion of the shelf 12 is now removably secured to the bar 26 where it is noted, that the flange portion 58 extends upwardly from a rear portion of the shelf 12.

After the rear edge trim 18 is secured, the open end of the U-shaped body of the front edge trim 16 is longitudinally lined up with the front bar 24. Then, the front edge trim 16 is mounted by being pushed in the direction of arrow 64 towards the shelf 12 so that the bar 24 is received therein within the bight portion 44. During this procedure, the rib 48 engages the lower surface of the support member 36 so that the upper and lower leg portions 40, 42 are slightly spread apart. Once the rib 48 is pushed past the support member 36, the upper and lower leg portions 40, 42 snap back so that the rib 48 now engages the lower surface of the shelf 12, with the upper leg portion 40 being engaged against an upper surface of the shelf 12, as best shown in FIG. 4. The shelf assembly 10 is now assembled.

Accordingly, when required, the shelf 12 can easily be removed by first removing the front and rear edge trims 16, 18 in a reverse manner to the above-mentioned assembling procedure.

Some refrigerators or freezers are provided with slide-out bins or storage drawers, which are slideably mounted on the shelf frames below the shelves. Due to the mounting arrangement, there is usually an undesired space between the upper portions of the bin and its associated shelf. Accordingly, FIGS. 5 and 6 show modified front and rear edge trims to compensate for the above-mentioned undesired space.

Figure 5:
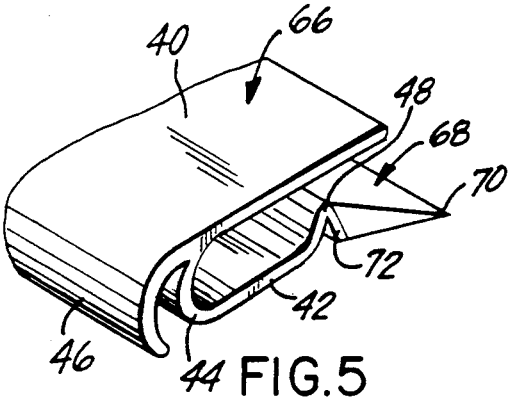
FIG. 5 is a fragmented perspective view showing a modified front edge trim.

FIG. 5 shows a modified front edge trim 66 having in most part the same construction as the above-mentioned front edge trim 16, including a longitudinally extending, substantially U-shaped body having the upper leg portion 40, the lower leg portion 42, the substantially rounded front bight portion 44, the longitudinally extending front lip portion 46, and the longitudinally extending inwardly directed rib 48. However, the front edge trim 66 also includes a bin sealing portion 68. The bin sealing portion 68 has a substantially V-shaped configuration to provide a longitudinally extending, free pointed edge 70 and a longitudinally extending thicker end portion 72. The end portion 72 is connected to the end surface of the lower leg portion 42 adjacent the rib 48, being disposed on the portion that is downwardly turned outwardly in the direction away from the upper leg portion 40 so that the bin sealing portion 68 rearwardly extends outwardly and downwardly away from the lower leg portion 42.

Figure 6:
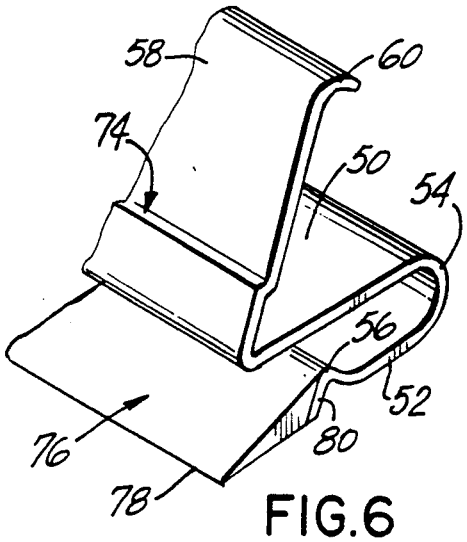
FIG. 6 is a fragmented perspective view showing a modified rear edge trim.

Likewise, FIG. 6 shows a modified rear edge trim 74 having in most part the same construction as the above-mentioned rear edge trim 18, including a longitudinally extending substantially U shaped body having the upper leg portion 50, the lower leg portion 52, the substantially rounded rear bight portion 54, the longitudinally extending inwardly directed rib 56, and the longitudinally extending front flange portion 58 with the free end portion 60. However, the rear edge trim 74 also includes a bin sealing portion 76. The bin sealing portion 76 has a substantially V-shaped configuration to provide a longitudinally extending, free pointed edge 78 and a longitudinally extending thicker end portion 80. The end portion 80 is connected to the end surface of the lower leg portion 52 adjacent the rib 56, being disposed on the portion that is downwardly turned outwardly in the direction away from the upper leg portion 50 so that the bin sealing portion 76 forwardly extends outwardly and downwardly away from the lower leg portion 52.

Preferably, each of the front and rear edge trims 66, 76 is formed by a twin extrusion, where one material, such as ABS mentioned above, is used to form the structure which is the same as the above-mentioned front and rear edge trims 16, 18, and a second additional material is used to form the pointed bin sealing portions 68, 76, such as a soft vinyl material of low durometer, such as urethane, so that the pointed bin sealing portions 68, 76 would be resilient and flexible, and could easily be deformed in its function, as mentioned below.

Figure 7:
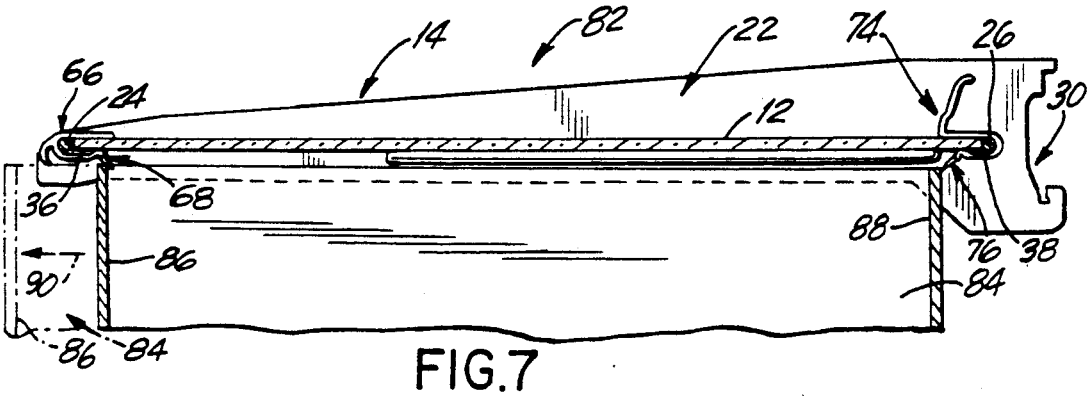
FIG. 7 is a fragmented side elevational view, partly in section, showing the front and rear edge trims of FIGS. 5 and 6 coacting with a storage drawer depending from the shelf.

Accordingly, FIG. 7 shows a shelf assembly 82 which for the most part is the same as the above-mentioned shelf assembly 10, except the shelf assembly 82 is provided with the above-mentioned front and rear edge trims 66, 76 of FIGS. 5 and 6. The front and rear edge trims are mounted on the shelf assembly 82 in the same above manner as shown in FIGS. 3 and 4. A slide-out bin or storage drawer 84 is slideably mounted on the shelf frame 14 below the shelf 12 in a conventional manner well known in the art so that a showing of the mounting means, which is not a part of the present invention, is not thought necessary, the mounting means usually being a tongue and groove arrangement to facilitate the sliding engagement.

The pointed bin sealing portion 68 of the front edge trim 66 rearwardly extends downwardly to engage behind a longitudinally extending top rear edge of the front wall 86 of the storage drawer 84. Likewise, the pointed bin sealing portion 76 of the rear edge trim 76 forwardly extends downwardly behind a longitudinally extending top rear edge of the rear wall 88 of the storage drawer 84. It is noted, that the front and rear walls 86, 88 of the storage drawer 84 abut against the pointed bin sealing portions 68, 76 in such a manner as to slightly deform the pointed bin sealing portion 68, 76 so that an air tight seal is formed therebetween to close the undesired space between the shelf assembly 82 and the storage drawer 84. When the storage drawer 84 is pulled out in the direction of arrow 90, as shown in broken lines, the pointed bin sealing portions 68, 76 spring back to their normal shape, as shown in FIGS. 5 and 6, to be in position to again be engaged by the front and rear walls 86, 88, when the storage drawer 84 is closed, to provide the air tight seal therebetween.

It is noted, that in the above embodiments, the additional support members 36, 38 are secured to the bars 24, 26 for supporting the front and rear edges of the shelf 12. Otherwise, without the support members 36, 38, a heavy weight or load placed on the shelf 12 could force the shelf 12 downwardly, thus causing the front and rear edge trims 16, 18 or 66, 76 to rotate around the bars 24, 26 so that the shelf 12 would not be stable. Thus, the support members 36, 38 function to maintain the shelf 12 in a suitable position. However, the front and rear edge trims can be modified so that the support members 36, 38 can be eliminated, as set forth below.

Figure 8:
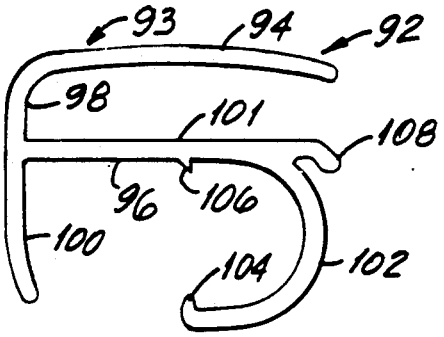
FIG. 8 is a side elevational view of a further modified front edge trim.

FIG. 8 shows a modified front edge trim 92 having a longitudinally extending, substantially U-shaped upper body portion 93 for engaging a front edge the shelf therein, including an upper leg portion 94, a lower leg portion 96 and a front bight portion 98. A longitudinally extending front lip portion 100 extends downwardly from the front part of the bight portion 98. The end portion of the lower leg portion 96 is arcuately curved downwardly approximately 180 degrees from the straight part 101 of the lower leg portion 96 to provide a bar gripping portion 102. The free end 104 of the bar gripping portion 102 is turned upwardly, and a pointed tab 106 is provided on the underside of the straight part 101 of the lower leg portion 96 in an aligned position above the free end 104. Furthermore, a cam portion 108 rearwardly projects outwardly from the rear of the straight part 101 of the lower leg portion 96, the function of which will be set forth below.

Figure 9:
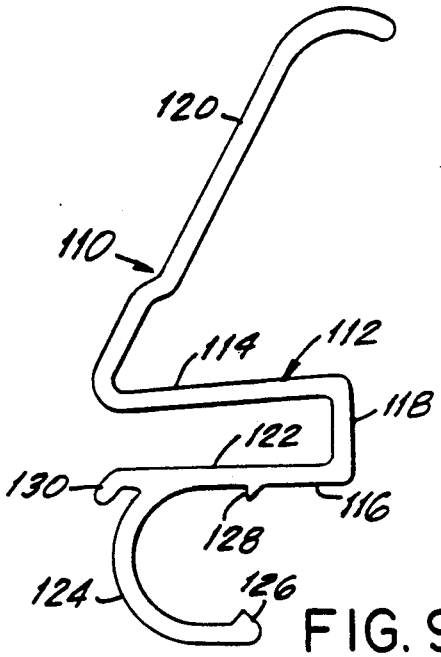
FIG. 9 is a side elevational view of a further modified rear edge trim.

Likewise, FIG. 9 shows a modified rear edge trim 110 having a longitudinally extending, substantially U-shaped body portion 112 for engaging the rear edge of the shelf therein, including an upper leg portion 114, a lower leg portion 116 and a rear bight portion 118. A longitudinally extending front flange portion 120 extends rearwardly and upwardly from the front portion of the upper leg portion 114 to overhang the upper leg portion 114 in a spaced apart arrangement. The flange portion 120 is the same as, and functions in the same manner as the above-mentioned flange portion 58.

The end portion of the lower leg portion 116 is arcuately curved downwardly approximately 180 degrees from the straight part 122 of the lower leg portion 116 to provide a bar gripping portion 124. The free end 126 of the bar gripping portion 124 is turned upwardly, and a pointed tab 128 is provided on the underside of the straight part 122 of the lower leg portion 96 in an aligned position above the free end 126. Furthermore, a cam portion 130 forwardly projects outwardly from the front of the straight part 122 of the lower leg portion 116, the function of which will be set forth below.

It is noted, that the front and rear edge trims 92, 110 are extruded in the same manner as mentioned above, being formed from the above-mentioned materials.

Figure 10:
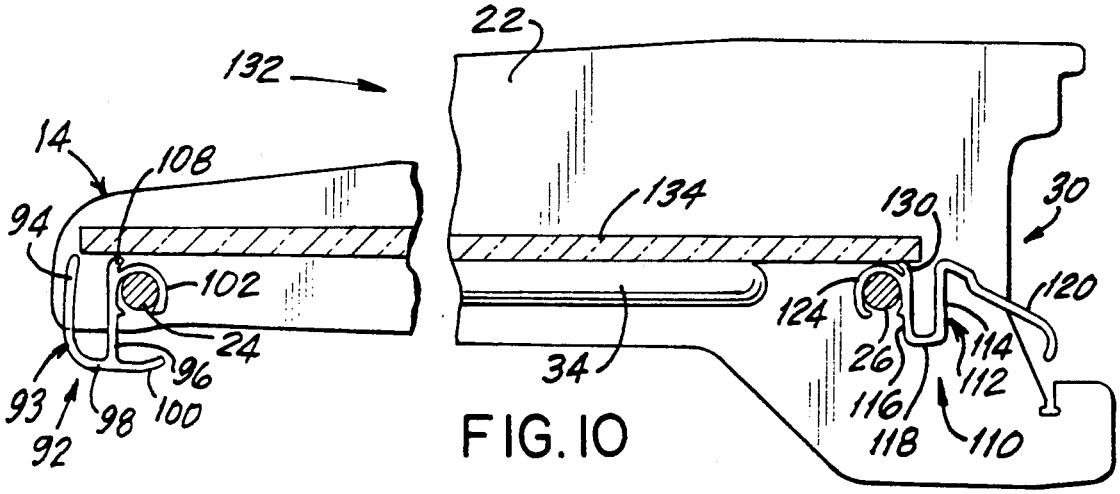
FIG. 10 is a fragmented side elevational view, partly in section, showing the front and rear edge trims of FIGS. 8 and 9 in the process of being installed on the shelf.
Figure 11:
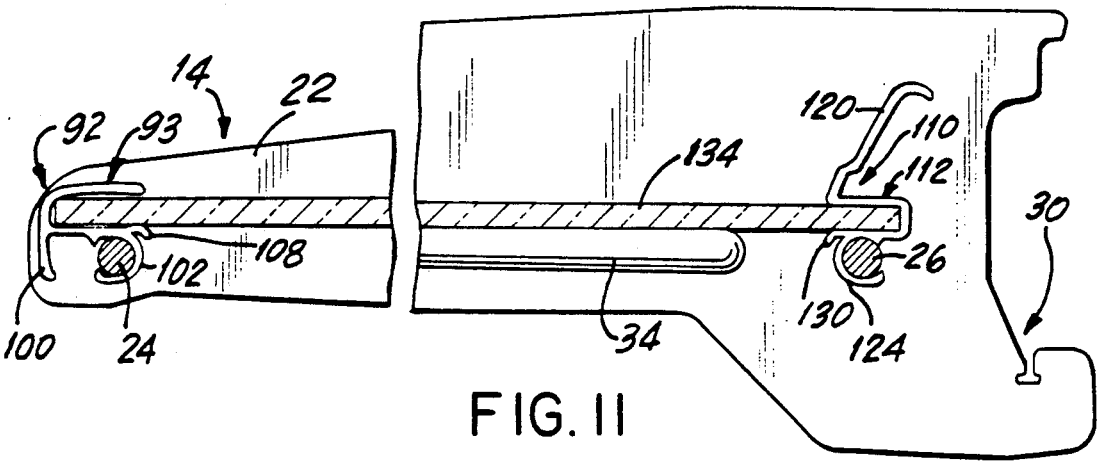
FIG. 11 is a fragmented side elevational view, partly in section, similar to FIG. 10, showing the front and rear edge trims of FIGS. 8 and 9 installed on the shelf.

Referring now to FIGS. 10 and 11, the assembling procedure for the modified shelf assembly 132 will now be described. As shown in FIG. 10, the bar gripping portion 102 of the front edge trim 92 is snapped onto the bar 24, and the bar gripping portion 124 of the rear edge trim 110 is snapped onto the bar 26 so that the mouths of the U-shaped body portions 93, 112 are at an uppermost position with the leg portions 94, 96 and 114, 116 being disposed in a vertical position, and with the bight portions 98, 118 being at a lower most position. A shelf 134, similar to but slightly longer than the above-mentioned shelf 12, is positioned on the front and rear edge trims 92, 110 at the mouths of the U-shaped body portions 93, 112, and is also resting on the ribs 32, 34 formed in the side frame portions 20, 22. It is noted, that the distance from the front edge to the rear edge of the shelf 134 is longer than the distance btween the bars 24, 26 so that the shelf front and rear edge portions overhang the bars 24, 26. It is further noted, in this position as shown in FIG. 10, the cam portions 108, 130 of the front and rear edge trims 92, 110 engage the bottom surface of the shelf 134.

Now, either together or one at a time, the front and rear edge trims 92, 110 are rotated about their respective bars 24, 26 to cam the front and rear edge trims 92, 110 onto the front and rear edges of the shelf 134 to the position shown in FIG. 11.

For example, the front edge trim 92 is rotated in a clockwise direction from the position shown in FIG. 10, so that the free end of the upper leg portion 94 is brought over the top of the front edge of the shelf 134. Continued rotation causes the upper and lower leg portions 94, 96 to spread apart, where the cam portion 108 guides the front edge of the shelf 134 into the space between the upper and lower leg portions 94, 96. The rotation continues until the shelf 134 is fully seated between the upper and lower leg portions 94, 96, which are now back to their normal spaced apart position, with the front edge of the shelf 134 being in engagement with the bight portion 98, as shown in FIG. 11.

Likewise, the rear edge trim 110 is rotated in a counterclockwise direction from the position shown in FIG. 10, so that the end of the upper leg portion 114 is brought over the top of the rear edge of the shelf 134. Continued rotation causes the upper and lower leg portions 114, 116 to spread apart, where the cam portion 130 guides the rear edge of the shelf 134 into the space between the upper and lower leg portions 114, 116. The rotation cotninues until the shelf 134 is fully sealed between the upper and lower leg portions 114, 116, which are now back to their normal spaced apart position, with the rear edge of the shelf 134 being in engagement with the bight portion 118, as shown in FIG. 11. Accordingly, the flange portion 120 extends upwardly from a rear portion of the shelf 134 to function as a decorative stop member, as mentioned above.

It is noted, that the free ends 104, 126 and the pointed tabs 106, 128 of the bar gripping portions 102, 124, respectively, engage the bars 24, 26, respectively, to rotatably secure the front and rear edge trims 92, 110 on the bars 24, 26, respectively.

Thus, the front and rear edge trims 92, 110 secure the shelf 134 to the bars 24, 26 of the frame 14. Since the shelf 134 is supported above the bars 24, 26, the shelf 134 is capable of supporting heavy weights or loads placed thereon, where the front and rear edge trims 92, 110 maintain the shelf 134 in a stable position.

It is noted, that when necessary, the shelf assembly 132 can easily be disassembled by reversing the above-mentioned assembling procedure. Thus, the front and rear edge trims 92, 110 can be easily replaced with other front and rear edge trims having a different structure or decorative appearance, such as a different color or texture. Different structures of the front and rear edge trims are set forth below.

Figure 12:
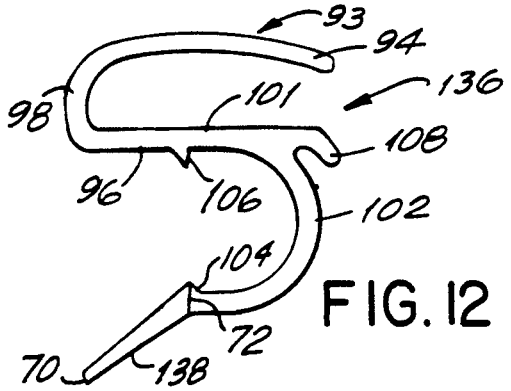
FIG. 12 is a side elevational view of another modified front edge trim.

As indicated above, a bin sealing portion was provided on the front and rear edge trims to compensate for the undesired space between the upper portions of the slide-out bin or storage drawer and its associated shelf. Accordingly, FIG. 12 shows a modified front edge trim 136 provided with a bin sealing portion 138. The front edge trim 136 has for most part a similar construction as the above-mentioned front edge trim 92, as shown in FIG. 8, including a longitudinally extending, substantially U-shaped upper body portion 93 having the upper leg portion 94, the lower leg portion 96 and the front bight portion 98, where the front lip portion has been eliminated. Additionally, the bar gripping portion 102 curves downwardly from the straight part 101 of the lower leg portion 96, the end 104 of the bar gripping portion 102 is disposed in an aligned position spaced below the pointed tab 106 on the underside of the straight part 101, and the cam portion 108 rearwardly projects outwardly from the rear of the straight part 101 of the lower leg portion 96.

The bin sealing portion 138 has a substantially V-shaped configuration, the same as above, to provide a longitudinally extending, free pointed edge 70 and a longitudinally extending thicker end portion 72 connected to the end surface of the end 104 of the bar gripping portion 102, so that the bin sealing portion 138 extends outwardly in a forward direction and downwardly away from the bar gripping portion 102.

Figure 13:
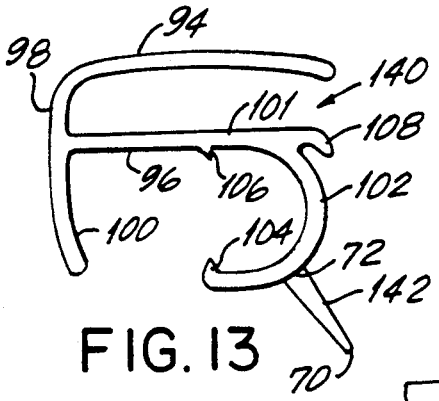
FIG. 13 is a side elevational view of still another modified front edge trim.

Likewise, FIG. 13 shows a further modified front edge trim 140 provided with a bin sealing portion 142. The front edge trim 140 is again for the most part the same as the above-mentioned front edge trim 92, as shown in FIG. 8, including a longitudinally extending, substantially U-shaped upper body portion 93 having the upper leg portion 94, the lower leg portion 96 and the front bight portion 98. Unlike the above front edge trim 136 of FIG. 12, the front edge trim 140 is provided with the front lip portion 100. Additionally, the bar gripping portion 102 curves downwardly from the straight part 101 of the lower leg portion 96, the free end 104 of the bar gripping portion 102 is disposed in an aligned position spaced below the pointed tab 106 on the underside of the straight part 101, and the cam portion 108 rearwardly projects outwardly from the rear of the straight part 101 of the lower leg portion 96.

The bin sealing portion 142 has a substantially V-shaped configuration, the same as above, to provide a longitudinally extending, free pointed edge 70 and a longitudinally extending thicker end portion 72. In this case, the end portion 72 is connected to a lower outer surface of the bar gripping portion 102, being horizontally spaced from the free end 104 and approximately 150 degrees from the pointed tab 106, so that the bin sealing portion 142 extends outwardly in a rearward direction and downwardly away from the bar gripping portion 102.

Figure 14:
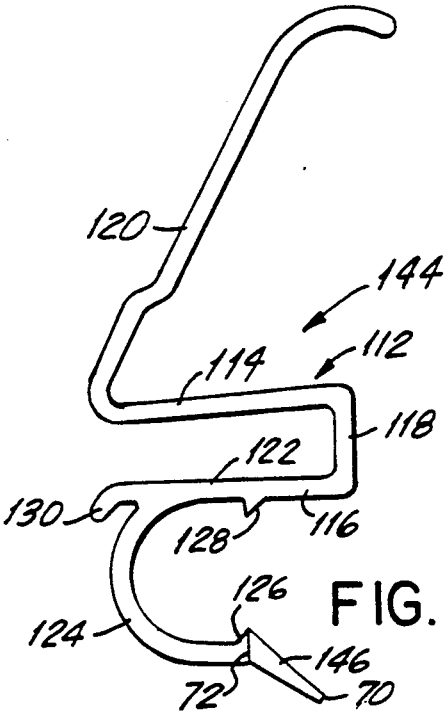
FIG. 14 is a side elevational view of another modified rear edge trim.

Accordingly, FIG. 14 shows a modified rear edge trim 144 provided with a bin sealing portion 146. The rear edge trim 144 has for the most part a similar construction as the above-mentioned rear edge trim 110, as shown in FIG. 9, including a longitudinally extending, substantially U-shaped body portion 112 having the upper leg portion 114, the lower leg portion 116 and the rear bight portion 118, with the longitudinally extending, front flange portion 120 extending rearwardly and upwardly from the front portion of the upper leg portion 114. Additionally, the bar gripping portion 124 curves downwardly from the straight part 122 of the lower leg portion 116, the end 126 of the bar gripping portion 124 is disposed in an aligned position spaced below the pointed tab 128 on the underside of the straight part 122, and the cam portion 130 forwardly projects outwardly from the front of the straight part 122 of the lower leg portion 116.

The bin sealing portion 146 again has a substantially V-shaped configuration, the same as above, to provide a longitudinally extending, free pointed edge 70 and a longitudinally extending thicker edge portion 72 connected to the end surface of the end 126 of the bar gripping portion 124, so that the bin sealing portion 146 extends outwardly in a rearward direction and downwardly away from the bar gripping portion 124.

It is noted, that the front edge trims 136, 140 and the rear edge trim 144 are extruded in the same manner as mentioned above, being formed from the above-mentioned materials.

Figure 15:
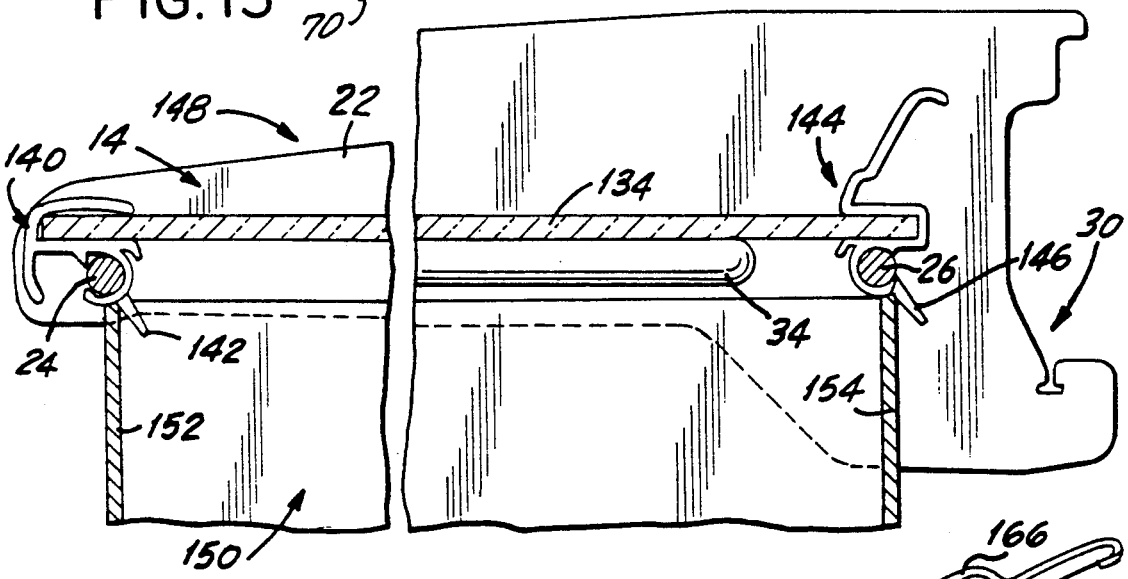
FIG. 15 is a fragmented side elevational view, partly in section, showing the front and rear edge trims of FIG. 13 and 14 installed on the shelf and coacting with a storage drawer depending from the shelf.

The assembling procedure for the front edge trims 136, 140 and the rear edge trim 144 is the same as described above with respect to FIGS. 10 and 11. For example, FIG. 15 shows a shelf assembly 148 which for the most part is the same as the above-mentioned shelf assembly 132, except the shelf assembly 148 is provided with the above-mentioned front and rear edge trims 140, 144 of FIGS. 13 and 14. A slide-out bin or storage drawern 150 is slideably mounted on the shelf frame 14 below the shelf 134 in a conventional manner well known in the art. The pointed bin sealing portion 142 of the front edge trim 140 extends downwardly to engage behind a longitudinally extending top rear edge of the front wall 152 of the storage drawer 150. Likewise, the pointed bin sealing portion 146 of the rear edge trim 144 extends downwardly behind a longitudinally extending top rear edge of the rear wall 154 of the storage drawer 150.

In a like manner as mentioned above, the front and rear walls 152, 154 of the storage drawer 150 abut against the pointed bin sealing portions 142, 146 in such a manner as to slightly deform the pointed bin sealing portions 142, 146 so that an air tight seal is formed therebetween to close the undesired space between the shelf assembly 148 and the storage drawer 150. When the storage drawer 150 is pulled out, the pointed bin sealing portions 142, 146 spring back to their normal shape, as shown in FIGS. 13 and 14, to be in position to again be engaged by the front and rear walls 152, 154, when the storage drawer 150 is closed, to provide the air tight seal therebetween.

Figure 16:
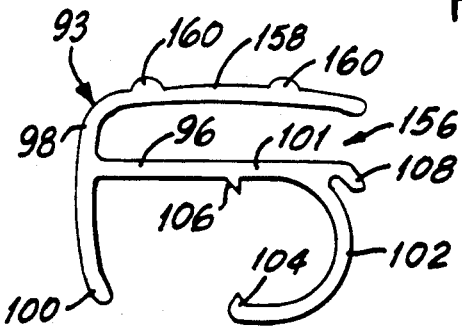
FIG. 16 is a side elevational view of yet another front edge trim.

FIG. 16 shows a still further modified front edge trim 156, which for the most part is the same as the above-mentioned front edge trim 92, shown in FIG. 8. However, unlike the above front edge trim 92, the front edge trim 156 is provided with a modified upper leg portion 158, which includes at least a pair of longitudinally extending, spaced apart ribs 160 on the upper surface thereof. The ribs 160 provide a non-skid upper surface on the upper leg portion 158, and also function to protect the finish on the upper surface of the upper leg portion 158 to avoid scratches and cuts therein, particularly when the upper surface of the upper leg portion 158 is provided with a decorative finish.

Figure 17:
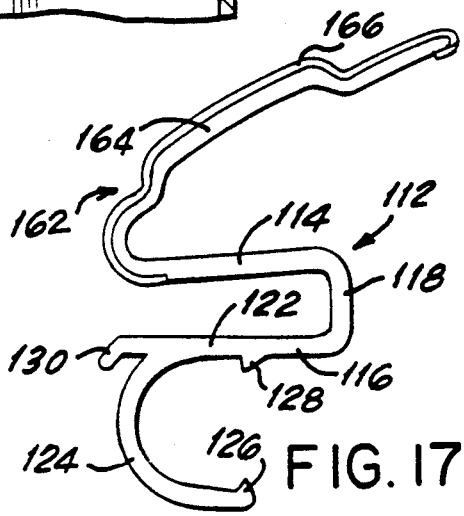
FIG. 17 is a side elevational view of yet another rear edge trim.

FIG. 17 shows a further modified rear edge trim 162, which for the most part is the same as the above-mentioned rear edge trim 110, shown in FIG. 9. However, unlike the above rear edge trim 110, the rear edge trim 162 includes a modified front flange portion 164, which has a slightly different construction than the front flange portion 120 of the rear edge trim 110, but functions in the same manner. The front flange portion 164 is provided with a longitudinally extending, metallic strip 166 on the outer exposed surface thereof to provide a decorative appearance. Preferably, to protect the outer surface of the metallic strip 166 from scratches and cuts, a protective transparent plastic material is disposed over the metallic strip 166.

It is noted, that the above front and rear edge trims 156, 162 can be provided with bin sealing portions in the same manner as mentioned above to coact with a slide-out bin or storage drawer depending from a shelf assembly having the front and rear edge trims 156, 162 thereon.

Figure 18:
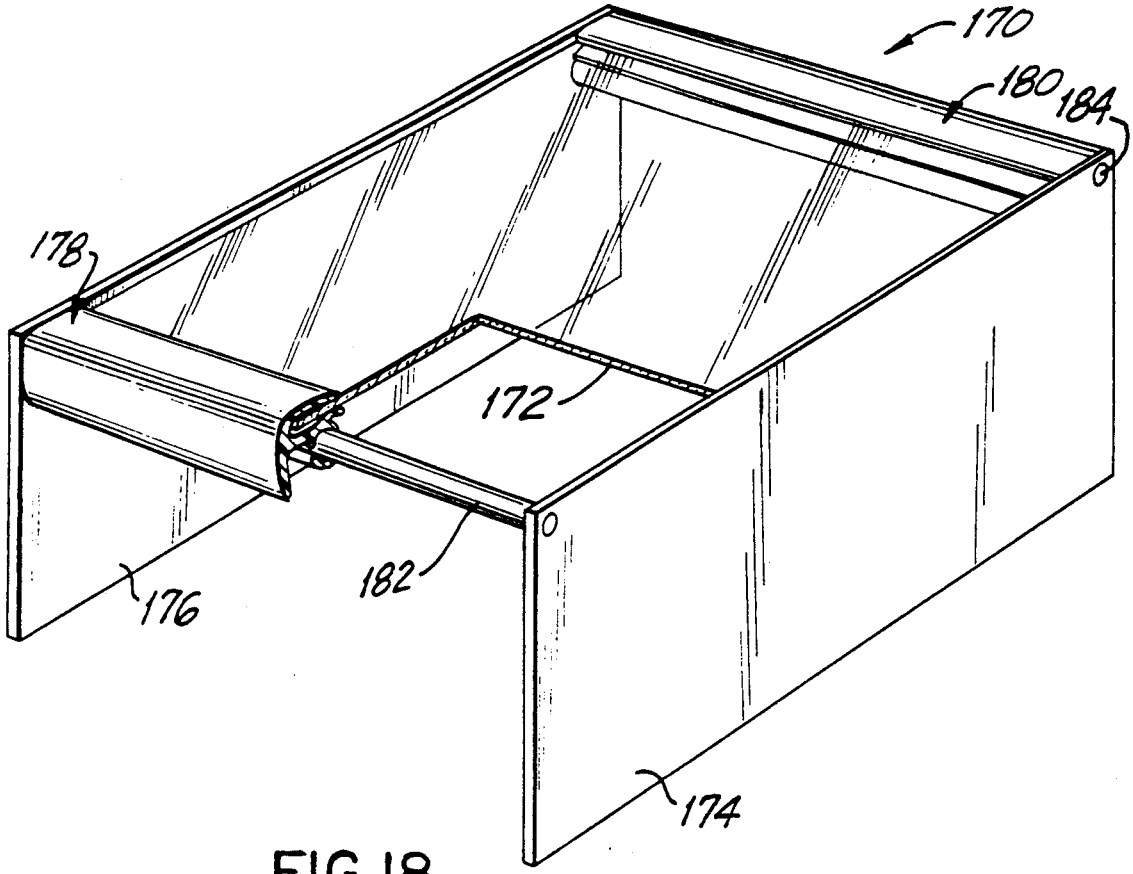
FIG. 18 is a fragmented perspective view showing a table constructed with front and rear edge trims in accordance with the present invention.

Obviously, the above-mentioned front and rear edge trims can be provided on shelves of different types of appliances, furniture and the like. For example, FIG. 18 shows a table 170 including an upper shelf or table top 172, preferably in the form of a glass plate, a pair of spaced apart legs or side panels 174, 176, and front and rear edge trims 178, 180 for enclosing the exposed front and rear edges of the shelf 172 and lockingly securing the shelf 172 between the legs 174, 176. A pair of transversely extending bars or rods 182, 184, preferably fabricated from a metal material, are securely fixed between the associated upper corner portions of the legs 174, 176. Preferably, the opposite ends of each of the bars 182, 184 have a reduced diameter and are fixedly secured in holes formed in the upper corner portions of the legs 174, 176 by suitable means, such as a force fit, cement, an adhesive and the like.

Figure 19:
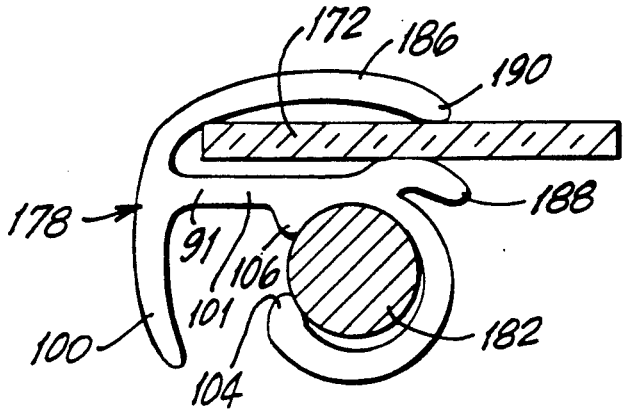
FIG. 19 is a fragmented enlarged side elevational view, partly in section, showing the front edge trim installed on the table.

The front and rear edge trims 178, 180 have the same identical construction, being substantially the same as the above-mentioned front edge trim 92, shown in FIG. 8. However, the upper leg portion 186 of the front and rear edge trims 178, 180 has a more curved configuration than the upper leg portion 94 of the front edge trim 92, and the cam portion 188 of the front and rear edge trims 178, 180 is slightly curved upwardly from the straight part 101 of the lower leg portion 96, as best shown in FIG. 19.

The assembling procedure for the table 170 is substantially the same as the above assembling procedure for the shelf assembly 132, shown in FIGS. 10 and 11, so that a further description thereof is not thought necessary. As noted in FIG. 19, the free end portion 190 of the upper leg portion 186 engages the upper surface of the shelf 172, and the upper surface of the cam portion 188 engages the lower surface of the shelf 172 to secure the shelf 172 to the bars 182 and 184. When required, the shelf 172 can be removed by rotating the front and rear edge trims 178, 180 back in opposite directions in the same manner mentioned above. Accordingly, the front and rear edge trims 178, 180 are extruded in the same manner as mentioned above, and are formed from the same material mentioned above, where the front and rear edge trims 178, 180 substantially function in the same manner mentioned above, so that a further description thereof is not thought necessary.

Numerous alterations of the structures herewith discussed will suggest themselves to those skilled in the art. However, it is to be understood that the present disclosure relates to preferred embodiments of the invention which are for purposes of illustration only, and are not to be construed as a limitation of the invention.

What is claimed is:

1. A shelf edge trim for an assembly including a shelf supported by spaced apart front and rear bars, and a slide-out storage drawer depending from the assembly, comprising:

a longitudinally extending plastic strip having an upper leg portion, a lower leg portion and a bight portion to provide a substantially U-shaped body portion;

said upper and lower leg portions removably receiving an edge portion of the shelf therebetween;

said bight portion providing bar engaging means for removably securing said body portion to an associated one of the front and rear bars in a gripping engagement to support the edge portion of the shelf with respect to the associated one of the front and rear bars; and bin sealing means provided on said body portion for sealing a space between the shelf and the slide-out storage drawer, said bin sealing means having a substantially V-shaped configuration to provide a longitudinally extending thick end connected to an end portion of said lower leg portion, and a free pointed longitudinal edge extending outwardly and downwardly from said end portion of said lower leg portion.

2. A shelf edge trim according to claim 1, wherein a longitudinally extending, inwardly directed rib is provided on an end portion of said lower leg portion for engaging an underside of the edge portion of the shelf.

3. A shelf edge trim according to claim 1, wherein said body portion is disposed on the front bar with the front bar being received in said bight portion to provide said bar engaging means, so that the edge portion of the shelf is positioned adjacent to the front bar.

4. A shelf edge trim according to claim 3, wherein a longitudinally extending front lip portion extends outwardly and downwardly from a front part of said upper leg portion to overhang said bight portion in a spaced apart arrangement.

5. A shelf edge trim according to claim 3, wherein support means are secured to the front bar for supporting the edge portion of the shelf, said lower leg portion being disposed against the support means, and said upper leg portion being disposed against an upper surface of the edge portion of the shelf to prevent rotation of said body portion around the front bar.

6. A shelf edge trim according to claim 1, wherein said body portion is disposed on the rear bar with the rear bar being received in said bight portion to provide said bar engaging means, so that the edge portion of the shelf is positioned adjacent to the rear bar.

7. A shelf edge trim according to claim 6, wherein a longitudinally extending front flange portion extends rearwardly and upwardly from a front part of said upper leg portion to overhang said upper leg portion in a spaced apart arrangement to provide a rear stop for the shelf.

8. A shelf edge trim according to claim 6, wherein support means are secured to the rear bar for supporting the edge portion of the shelf, said lower leg portion being disposed against the support means, and said upper leg portion being disposed against an upper surface of the edge portion of the shelf to prevent rotation of said body portion around the rear bar.

9. A shelf edge trim according to claim 6, wherein a second shelf edge trim having a second U-shaped body portion is disposed on the front bar with the front bar being received in a second bight portion of said second body portion, and an opposite edge portion of the shelf being positioned adjacent to the front bar between second upper and lower leg portions of said second body portion so that the shelf is removably secured between said first mentioned and second shelf edge trims.

10. A shelf edge trim for an assembly including a shelf supported by spaced apart front and rear bars, comprising:

a longitudinally extending plastic strip having an upper leg portion, a lower leg portion and a bight portion to provide a substantially U-shaped body portion;

said upper and lower leg portions removably receiving an edge portion of the shelf therebetween;

bar engaging means for removably securing said body portion to an associated one of the front and rear bars in a gripping engagement to support the edge portion of the shelf with respect to the associated one of the front and rear bars; and said bar engaging means including a bar gripping portion arcuately curving downwardly at least approximately 180 degrees outwardly from a free end part of said lower leg portion to receive the associated one of the front and rear bars therein;

whereby when the shelf is supported on the front and rear bars, and when the bar gripping portion is disposed on the associated one of the front and rear bars, said bar gripping portion permits said body portion to be rotated about the associated one of the front and rear bars so that said upper and lower leg portions receive the edge portion of the shelf therebetween.

11. A shelf edge trim according to claim 10, wherein a free end of said bar gripping portion is turned upwardly to capture the associated one of the front and rear bars within said bar gripping portion.

12. A shelf edge trim according to claim 11, wherein an extending tab is provided on an underside of said free end part of said lower leg portion in a coacting position with said free end of said bar gripping portion to assist in the capture of the associated one of the front and rear bars within said bar gripping portion.

13. A shelf edge trim according to claim 10, wherein said bar gripping portion is provided with bin sealing means for sealing a space between the shelf and a slide-out storage drawer depending from the assembly, said bin sealing means having a substantially V-shaped configuration to provide a longitudinally extending thick end portion connected to said bar gripping portion, and a free pointed edge extending outwardly and downwardly from said bar gripping portion.

14. A shelf edge trim according to claim 13, wherein said thick end portion of said bin sealing means is connected to a free end of said bar gripping portion.

15. A shelf edge trim according to claim 13, wherein said thick end portion of said bin sealing means is connected to a lower outer surface of said bar gripping portion, said thick end portion being horizontally spaced from a free end of said bar gripping portion.

16. A shelf edge trim according to claim 10, wherein cam means are provided on said lower leg portion to guide the edge portion of the shelf into said U-shaped body portion between said upper and lower leg portions, said cam means projecting outwardly from an end of said free end part of said lower leg portion.

17. A shelf edge trim according to claim 10, wherein a longitudinally extending front lip portion extends downwardly from a front part of said bight portion to be disposed in front of said bar gripping portion.

18. A shelf edge trim according to claim 10, wherein a longitudinally extending front flange portion extends rearwardly and upwardly from a front part of said upper leg portion to overhang said upper leg portion in a spaced apart arrangement to provide a rear stop for the shelf.

19. A shelf edge trim according to claim 10, wherein said bar gripping portion is mounted on the front bar, and a second bar gripping portion of a second shelf edge trim is mounted on the rear bar to secure the shelf to the front and rear bars and removably maintain the shelf between said first mentioned and second shelf edge trims.

20. A shelf edge trim according to claim 19, wherein the shelf is a table top, and said first mentioned and second shelf edge trims on the front and rear bars have identical constructions.

* * * * *